United States Patent [19]

Angelino

[11] Patent Number: 4,730,436

[45] Date of Patent: Mar. 15, 1988

[54] MACHINE FOR WRAPPING A PACKAGE IN A STRETCHABLE AND THEN COLD-AND/OR HOT-CONTRACTIBLE FILM

[75] Inventor: Gianfranco Angelino, Alessandria, Italy

[73] Assignee: Val.Mec S.r.l., Canelli, Italy

[21] Appl. No.: 836,442

[22] Filed: Mar. 5, 1986

[30] Foreign Application Priority Data

Mar. 13, 1985 [IT] Italy ..... 67250 A/85

[51] Int. Cl.[4] ..... B65B 11/58; B65B 11/08

[52] U.S. Cl. ..... 53/170; 53/176; 53/449; 53/556; 53/588

[58] Field of Search ..... 53/170, 176, 210, 449, 53/465, 556, 580, 220, 526, 528, 441, 587, 588; 198/411, 415, 416

[56] References Cited

U.S. PATENT DOCUMENTS

| | | | |
|---|---|---|---|
| 3,269,513 | 8/1966 | Rosso | 198/416 |
| 3,722,657 | 3/1973 | Kienle et al. | 198/415 |
| 3,999,357 | 12/1976 | Marantz | 53/449 |
| 4,050,220 | 9/1977 | Lancaster et al. | 53/588 |
| 4,085,839 | 4/1978 | Crawford | 198/411 |
| 4,553,374 | 11/1985 | Lancaster et al. | 53/210 |
| 4,593,518 | 6/1986 | Lancaster | 53/210 |

FOREIGN PATENT DOCUMENTS

| | | | |
|---|---|---|---|
| 3431628 | 3/1986 | Fed. Rep. of Germany | 53/588 |
| 2154537 | 9/1985 | United Kingdom | 53/449 |

*Primary Examiner*—Robert L. Spruill
*Assistant Examiner*—Donald R. Studebaker
*Attorney, Agent, or Firm*—Young & Thompson

[57] ABSTRACT

A machine for wrapping a package in a stretchable and then cold- and/or hot-contractible film comprises two identical successive stations located along a line for feeding the packages and comprising each a rotatable support member positioned about the feeding line, on which there is rotatably mounted at least a coil of film which unwinds and envelops the advancing packages, and comprising also a cutting device, positioned downstream the support member to cut the film between two adjacent packages; also provided between the two stations and means for rotating the packages through 90° so that the packages which come out from the machine will have two sheets of film wound about each package and both of them on two opposite faces thereof, but positioned orthogonally to one another, and a single sheet of film wound on the remaining sides of the package.

3 Claims, 8 Drawing Figures

MACHINE FOR WRAPPING A PACKAGE IN A STRETCHABLE AND THEN COLD-AND/OR HOT-CONTRACTIBLE FILM

DESCRIPTION

This invention relates to a machine for wrapping a package in a stretchable and then cold-contractible and/or hot-contractible film.

The technique for enveloping packages in stretchable and then contractible films is very largely used in the last years, so much so that many machines exist at the present time for such purpose. It is substantially a matter of machines comprising a conveyor belt on which the packages advance side by side and along which a support member is mounted which has a coil rotatably mounted thereon, round which the film is wound.

As the packages advance, the film is wound on them under tension, said film being unwound from the coil which rotates on the support member. The packages are then separated from each other by means of a cutting device which cuts the film between two adjacent packages. At the same time the film contracts on the packages, thus rendering inseparable the elements of each package.

Many of these machines have the serious disadvantage consisting in that, since the film is wound obliquely round the package, and this latter advances while being enveloped by the film, a torsion on the packages is created due to the transverse tension of the film which tends to deform the package. This disadvantage is noxious not only to the aesthetical appearance of the package which appears twisted badly, but also because in the long run this deformation tends to worsen owing to the successive continuous contraction of the film so that this latter may also break or some element of the package may come out from the film, thus irreparably damaging the package.

To obviate this serious drawback the invention provides a machine by means of which two films are wound on the package in two different stations, between which the package is rotated through 90°. In this way, the tensions produced by the first film wound round the package are compensated and their noxious effects eliminated by the second film which is wound crosswise round the first film. Moreover, this solution not only produces a double winding onto certain faces of the packages, but also winds the film on all the faces of the package, thus enveloping it entirely. In fact, referring to the most common case of packages having a prismatic quadrilateral configuration (cube, parallelepiped), the first film envelops four sides of the package and the second film envelops two opposite sides of the packages which are enveloped by the first film and the other two sides which are left free by the first film, this being due to the 90° rotation of the package between the two wrapping stations.

In addition to the elimination of the tensions of the film a further advantage is obtained which consists in that the package is enveloped round its entire surface, thus obtaining obvious advantages not only from the aesthetical, but also from the hygienical viewpoints.

To attain these and other objects which will become more clearly apparent later, the invention provides a machine for wrapping a package in a stretchable and then cold- and hot-contractible film, characterized in comprising two successive identical stations located along the package feeding line, including each: a support member positioned round said feeding line and on which there is rotatably mounted at least a coil of a film which unwinds therefrom and is wound round the advancing package, and a cutting device located downstream the support member and intended to cut the film between two adjacent packages; between said two stations there being provided also means for rotating the packages through 90°.

The machine according to the invention will now be described with reference to the annexed drawings, in which.

Figure 1:
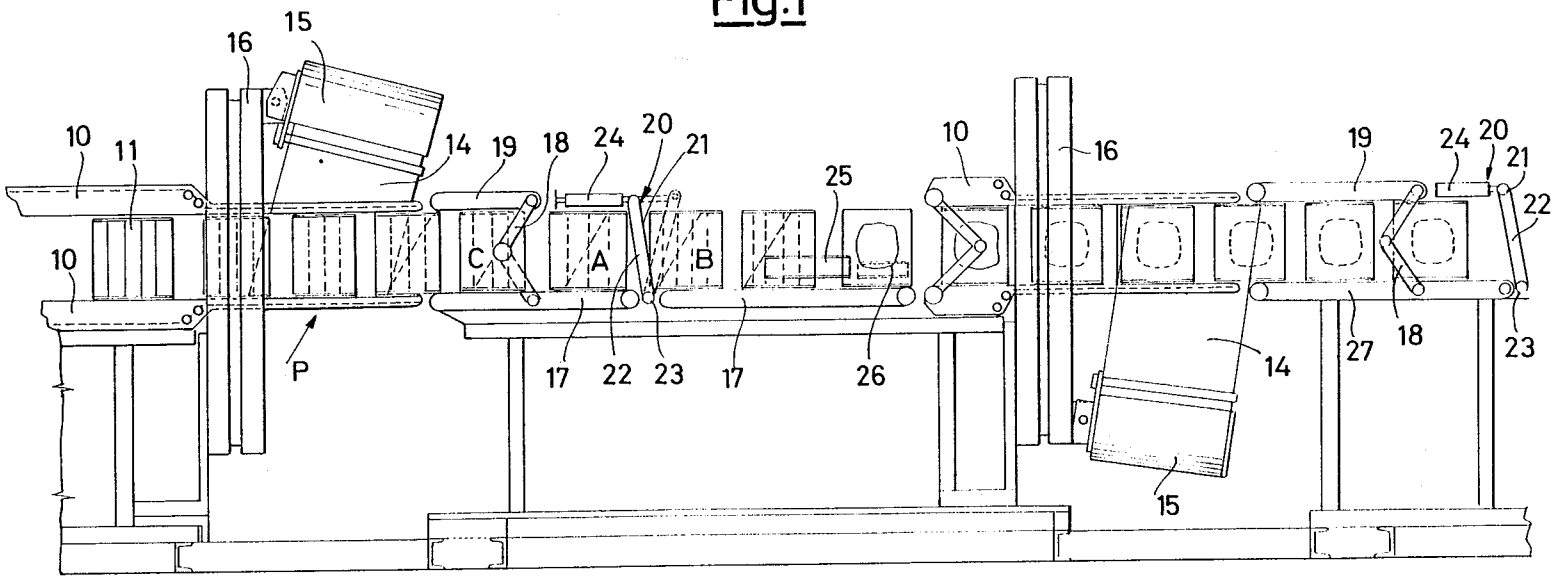
FIG. 1 is an elevational front view of the machine according to the invention.
Figure 5B:
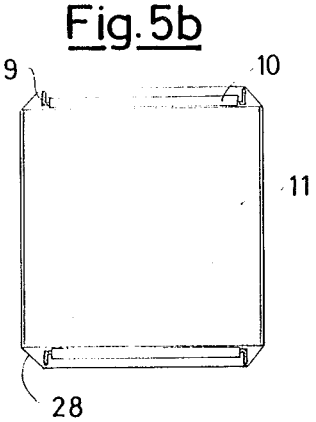
Figure 5A:
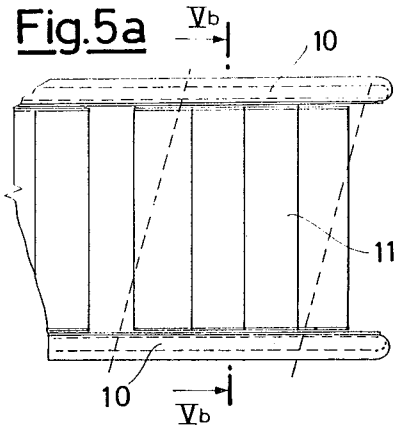

FIG. 5*a* is an enlarged view of the detail P of FIG. 1;

FIG. 5*b* is a sectional view along line V—V of FIG. 5*a;*

Figure 6:
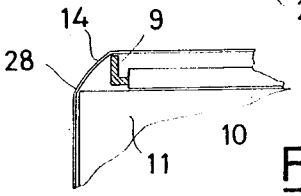

FIG. 6 is an enlarged view of the upper left corner of FIG. 5*b;* and

Figure 7:
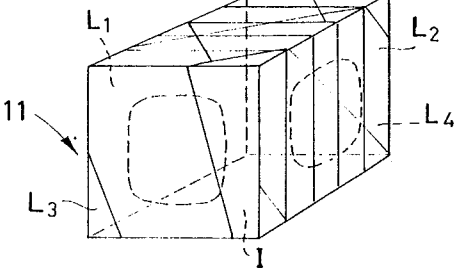

FIG. 7 is a perspective view of a package wrapped in a film by means of the machine shown in FIG. 1.

FIG. 1 shows a conveyor belt 10 which carries packages 11 represented generally in the shape of cubic configurations and formed by five boxes positioned side by side.

Obviously, this is only an exemplifying configuration of a package, which however may be formed in any shape and dimensions whatever, depending on what is to be enveloped, i.e. boxes, cans, bottles etc.

Conveyor belt 10 comprises a lower and an upper member and is formed by a fixed frame with rolls from which metallic side walls 9 extend which are bent perpendicularly to the rolls (see FIGS. 5*b* and 6).

Wrapped around these side walls 9 is the film 14 which unwinds from at least a coil 5 rotatably mounted on a support member 16 inserted along the line for feeding the packages 11.

Figure 2:
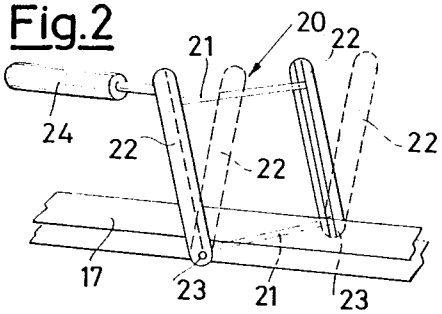
FIG. 2 is a perspective view of a detail of the machine.

Positioned beyond the support member 16 is a conveyor belt 17 connected by means of articulated kinematic mechanisms 18 to an upper conveyor belt 19 which presses the package by moving in accordance with the dimensions of this latter thanks to said kinematic mechanism 18. Since all the packages, in this section of advancement, are connected to each other by the film 14, downstream said upper guide 19 there is provided a cutting device 20 (FIGS. 1 and 2) formed by a blade 21 slidable along parallel guides 22 hinged at 23 to the frame of the machine. A piston 24 makes guides 22 rotate during the descent of the blades to the position shown by dashed lines in FIG. 1 and 2, in order to cut the film between two adjacent packages first during the descent of the blade and then during the ascent thereof, as will be explained later.

A pair of conveyor belts 25 and 26 (FIGS. 1 and 3) are mounted, with their axis vertical, beyond the cutting device 20, the first of said conveyors rotating in direction opposite to the feeding direction of the packages 11 which now are separated from each other, but are each compacted by the film 14.

Figure 3:
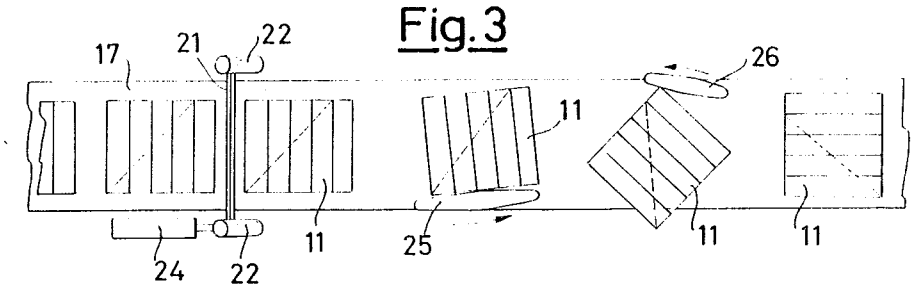
FIG. 3 is a plan view of a section of the machine.

The two conveyor belts 25 and 26 make the package perform a rotation through 90° on the feeding plane, so that the package is positioned on the conveyor belt 17 as shown in the right-hand portion of FIG. 3.

Figure 4:
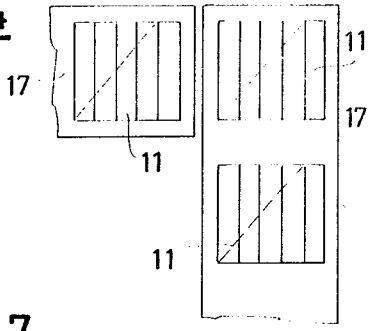
FIG. 4 is a plan view of a section of the machine according to an alternative embodiment of the machine shown in FIG. 1.

It would also be possible to orient the packages 11 by simply forming the guides 17 in the manner shown in FIG. 4, i.e. of two sections disposed at 90° from one another.

In this case, the machine would no more be rectilinear as shown in FIG. 1, but would extend at right angle, and in certain cases of limited availability of space this solution could even be more advantageous than the preceding one, since it would also offer the possibility of rotating the packages through 90° without the aid of the conveyor belts 25 and 26 or other expensive and/or complex means.

Mounted downstream the guides 25 and 26 or the division shown in FIG. 4, beyond the belt 17, is a second group exactly identical to that formed by the belt 10, i.e. a group comprising the belts 10, the support member 16 with the coil 15 of film 14, the belt 19 with the kinematic mechanism 18 for the connection to a lower belt 27, and the cutting device 20 beyond which the packages are moved away from the machine which is being described.

When the packages reach the first conveyor belts 10 and are made to advance between the rolls, film 14 is wound round the upper and lower side walls of the belts 10, but contacts the edges 28 and the side surfaces of the package (see FIG. 6), left free from the side walls 9 of the belt 10, which edges drag the film 14 together with the packages 11; in this way, when the packages leave the belts 10 during the advancement, the film 24 retracts on the walls of the package which before confronted the moving surfaces of the belts 10, thus forming a first covering which forms the package; i.e. unites the various parts which compose the package, but presents the torsional disadvantages described in the preamble.

The cutting device 20, by its up and down movement and contemporaneous rotation of its guides 22, will cut the film in the section which unites two adjacent packages; in fact ,the film 14 is fed continuously by the coils 15 which rotate on the support member 16, and winds spirally not only on the packages 11 but also in the sections of separation of these latter, so that it is necessary to cut the film in these sections in order to separate the packages from each other. The configuration of the cutting device shown in FIG. 2 enables it to cut the film during the descent between two packages A and B and then during the ascent between the packages A and C, thus avoiding dead times between the two phases.

By means of the solution of FIG. 3 or that of FIG. 4 the packages are made to rotate through 90° and therefore they are made to advance along the same group which has now been described; in this way, the packages will be wrapped by a second film ribbon which will cover again the upper face S and the lower face I of the package 11 (see FIG. 7), but with stripes oriented 90° relative to the first stripes, whilst it will be wound round the two side faces $L_1$ and $L_2$ which after the first winding had no film thereon since this latter has been wrapped round the other two side faces $L_3$ and $L_4$. In this way a package 11 is obtained in which the film wraps in one layer all four side surfaces $L_1$, $L_2$, $L_3$ and $L_4$, while it wraps in two orthogonal layers the upper face S and the lower face I. This ensures a double advantage: first of all the two orthogonal layers of the faces S and I compensate and annul the tensions of the film 14 on the package which thus remains perfectly balanced also in the long run; secondly, since all faces of the package are wrapped by at least one layer of film, the package is coated entirely, with obvious hygienical and protectve advantages against humidity and water for the products contained in the package, during their storage and transport.

What is claimed is:

1. A machine for wrapping a package in a stretchable and then contractible film, comprising two successive identical wrapping stations and conveyor means for conveying package to be wrapped first through one said station and then through the other said station, each said station including a support member surrounding said conveyor means, means for supporting a roll of said film on said support member and for advancing said roll of film about the conveyor means to wrap film that unwinds from said roll in a sprial wrapping about packages moving on the conveyor means, a cutting device between said stations to cut the film between two adjacent packages, and means between said cutting means and the stations through which the packages last pass, for rotating the packages through 90°, whereby said film is spiral wound on the packages first in one direction and then spiral wound on the packages at 90° to said first direction.

2. A machine as claimed in claim 1, in which said means for rotating the package through 90° comprises two conveyor belts whose directions of movement are perpendicular to each other.

3. A machine as claimed in claim 1, said conveyor means comprising upper and lower conveyor means between which the packages are advanced, said upper and lower conveyor means having flanges along their opposite side edges that extend away from the packages and are upstanding from the conveyor means, the wrapped film being in contact with side walls of the packages and with the free edges of said flanges whereby the friction of the film on the package is substantially greater than the friction of the film with the conveyor means, whereby the package drags the film along the conveyor means.

* * * * *